US007270032B1

(12) United States Patent
Hsieh

(10) Patent No.: US 7,270,032 B1
(45) Date of Patent: Sep. 18, 2007

(54) FITTING HOLE OF A HAND TOOL

(76) Inventor: Chih-Ching Hsieh, No. 367, Pei Yang Road, Fieng, Yuan City, Taichung Hsien (TW)

( * ) Notice: Subject to any disclaimer, the term of this patent is extended or adjusted under 35 U.S.C. 154(b) by 0 days.

(21) Appl. No.: 11/378,372

(22) Filed: Mar. 20, 2006

(51) Int. Cl.
*B25B 13/06* (2006.01)

(52) U.S. Cl. ..... 81/121.1; 81/186

(58) Field of Classification Search ..... 81/119, 81/121.1, 186, 441
See application file for complete search history.

(56) References Cited

U.S. PATENT DOCUMENTS 3,885,480 A * 5/1975 Muenchinger ..... 81/121.1
5,832,792 A * 11/1998 Hsieh ..... 81/124.6
6,079,299 A * 6/2000 Sundstrom ..... 81/121.1
6,098,501 A * 8/2000 Sundstrom ..... 81/121.1
6,904,833 B2 * 6/2005 Wright ..... 81/121.1
6,962,100 B2 * 11/2005 Hsien ..... 81/186
7,107,879 B1 * 9/2006 Cheng ..... 81/121.1
2002/0184976 A1 * 12/2002 Mizuno et al. ..... 81/121.1
2004/0149088 A1 * 8/2004 Yamamoto ..... 81/121.1
2004/0221688 A1 * 11/2004 Liao ..... 81/121.1
2006/0117917 A1 * 6/2006 Lin ..... 81/125
2006/0130618 A1 * 6/2006 Hsieh ..... 81/121.1

* cited by examiner

*Primary Examiner*—D. S. Meislin
(74) *Attorney, Agent, or Firm*—Troxell Law Office, PLLC

(57) ABSTRACT

A fitting hole of a hand tool such as a socket or a wrench for fitting on and wrenching a screwing member. The inner wall of the fitting hole is formed with twelve teeth at equal intervals. The teeth define therebetween twelve recesses at equal intervals. Each tooth has a tip formed with a plane. The plane of the tooth and a tangent of the tooth contain an angle of 15 degrees. A first end of the plane is closer to a center of the fitting hole. A second end of the plane of the tooth is farther from the center of the fitting hole. An arced tooth section is formed on one side of the tooth. The fitting hole can be fitted on various screwing members to wrench the same, and is applicable to both normal and worn screwing members.

11 Claims, 7 Drawing Sheets

FITTING HOLE OF A HAND TOOL

BACKGROUND OF THE INVENTION

The present invention is related to a hand tool, and more particularly to a socket or a wrench having a fitting hole for fitting with various screwing members. The fitting hole is applicable to both normal and worn screwing members.

The conventional wrench or socket has a polygonal fitting hole for fitting with and wrenching screwing members such as bolts and nuts. There are various existent screwing members. It is tried by the applicant to provide a hand tool having a fitting hole applicable to various kinds of screwing members.

In addition, after repeatedly used, the screwing members will be worn and blunted. It is also tried by the applicant to provide a hand tool having a fitting hole applicable to both normal and worn screwing members.

SUMMARY OF THE INVENTION

It is therefore a primary object of the present invention to provide a fitting hole of a hand tool, which is applicable to both normal and worn screwing members.

It is a further object of the present invention to provide the above fitting hole of the hand tool, which is applicable to various kinds of screwing members.

The present invention can be best understood through the following description and accompanying drawings wherein:

DETAILED DESCRIPTION OF THE PREFERRED EMBODIMENTS

Figure 1:
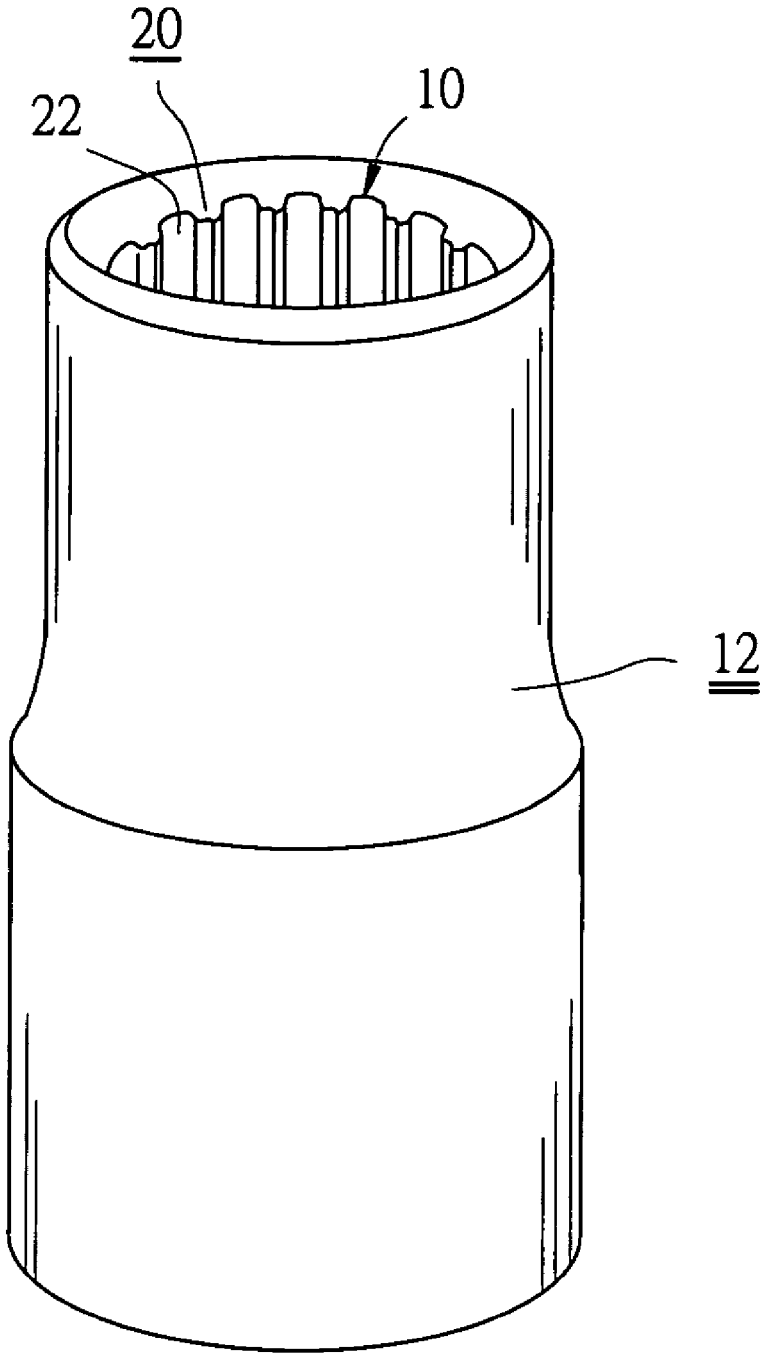
FIG. 1 is a perspective view of a preferred embodiment of the present invention applied to a socket.
Figure 2:
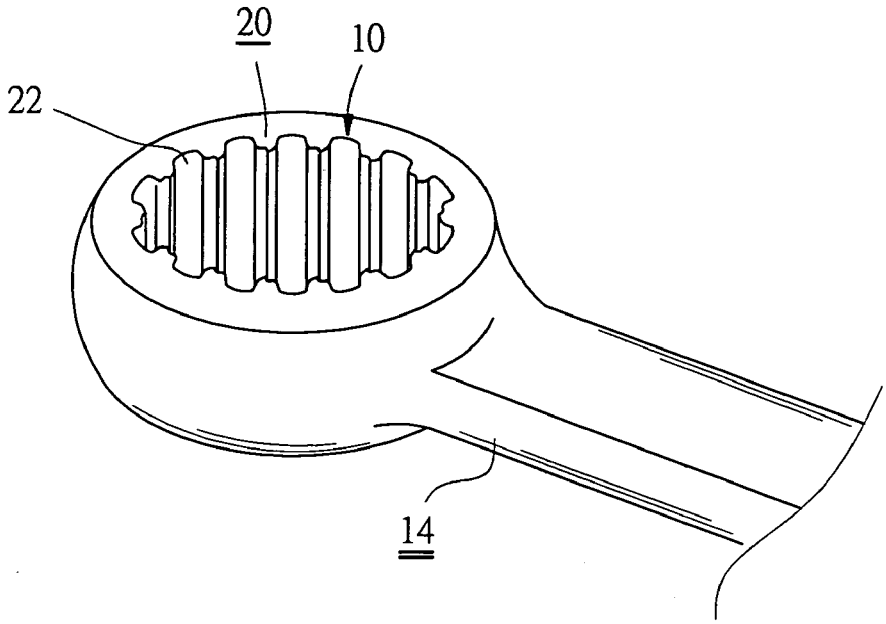
FIG. 2 is a perspective view of another embodiment of the present invention applied to a splined wrench.
Figure 3:
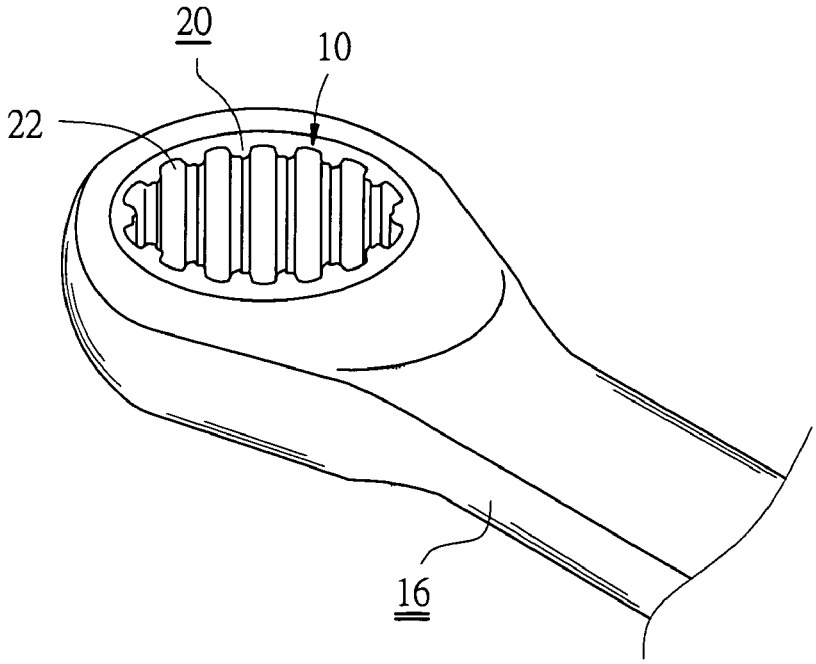
FIG. 3 is a perspective view of still another embodiment of the present invention applied to a ratchet wrench.

The present invention provides a fitting hole of a hand tool such as a socket or a wrench. FIGS. 1 to 3 respectively show a socket 12, a splined wrench 14 and a ratchet wrench 16 having the fitting hole 10 of the present invention.

Figure 4:
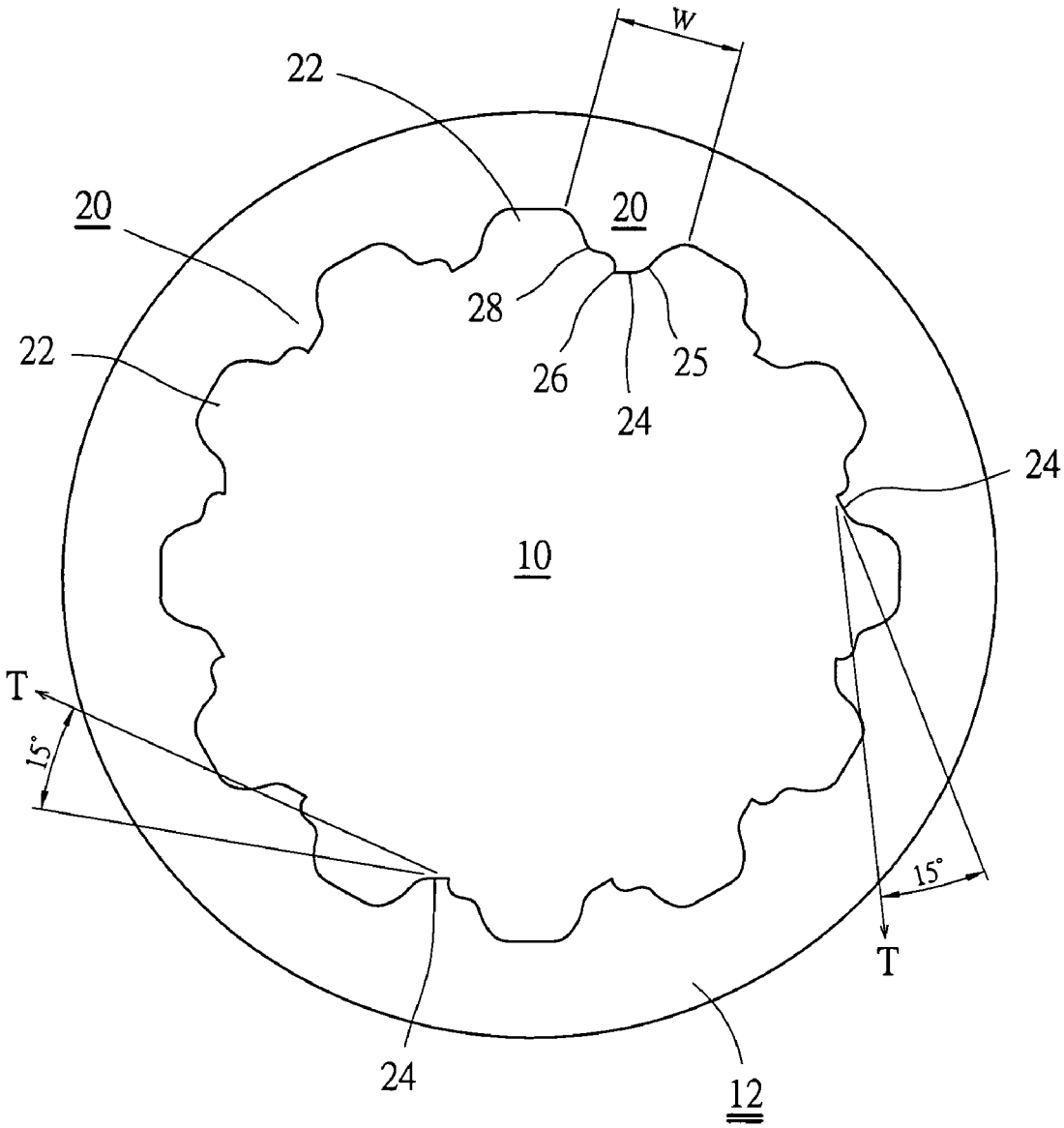
FIG. 4 is a top view according to FIG. 1.

Referring to FIG. 4, the inner wall of the fitting hole 10 is formed with twelve teeth 20 at equal intervals. The teeth 20 define therebetween twelve recesses 22 at equal intervals.

Each tooth 20 has a tip directed to the center of the fitting hole 10. The tip is formed with a plane 24. One end of the plane 24 is formed with an obtuse angle 25. The other end of the plane 24 is formed with an acute angle 26. The acute angle 26 is closer to the center of the fitting hole 10, while the obtuse angle 25 is farther from the center of the fitting hole 10. Preferably, the acute angle 26 is positioned in the middle of the width W of the tooth 20, but this is not limited. In addition, an arced tooth section 28 is formed on one side of each tooth 20. The obtuse tooth 25 is formed on the other side of the tooth.

Referring to FIG. 4, the plane of the tooth can be defined in a manner as follows:

Each tooth 20 has a tangent T. The plane 24 of the tooth 20 and the tangent T contain an angle of 15 degrees. The planes' of the teeth are inclined in the same direction. Accordingly, referring to FIG. 5, when the fitting hole 10 is fitted onto a hexagonal screwing member 30, two teeth 20*a*, 20*b* contact with one side 32 of the screwing member 30. The plane 24 of the tooth 20*a* is attached to the side 32 of the screwing member. On the other hand, the acute angle 26 of the tooth 20*b* contacts with the screwing member 30 with the plane 24 of the tooth 20*b* inclined from the side 32 of the screwing member.

Figure 5:
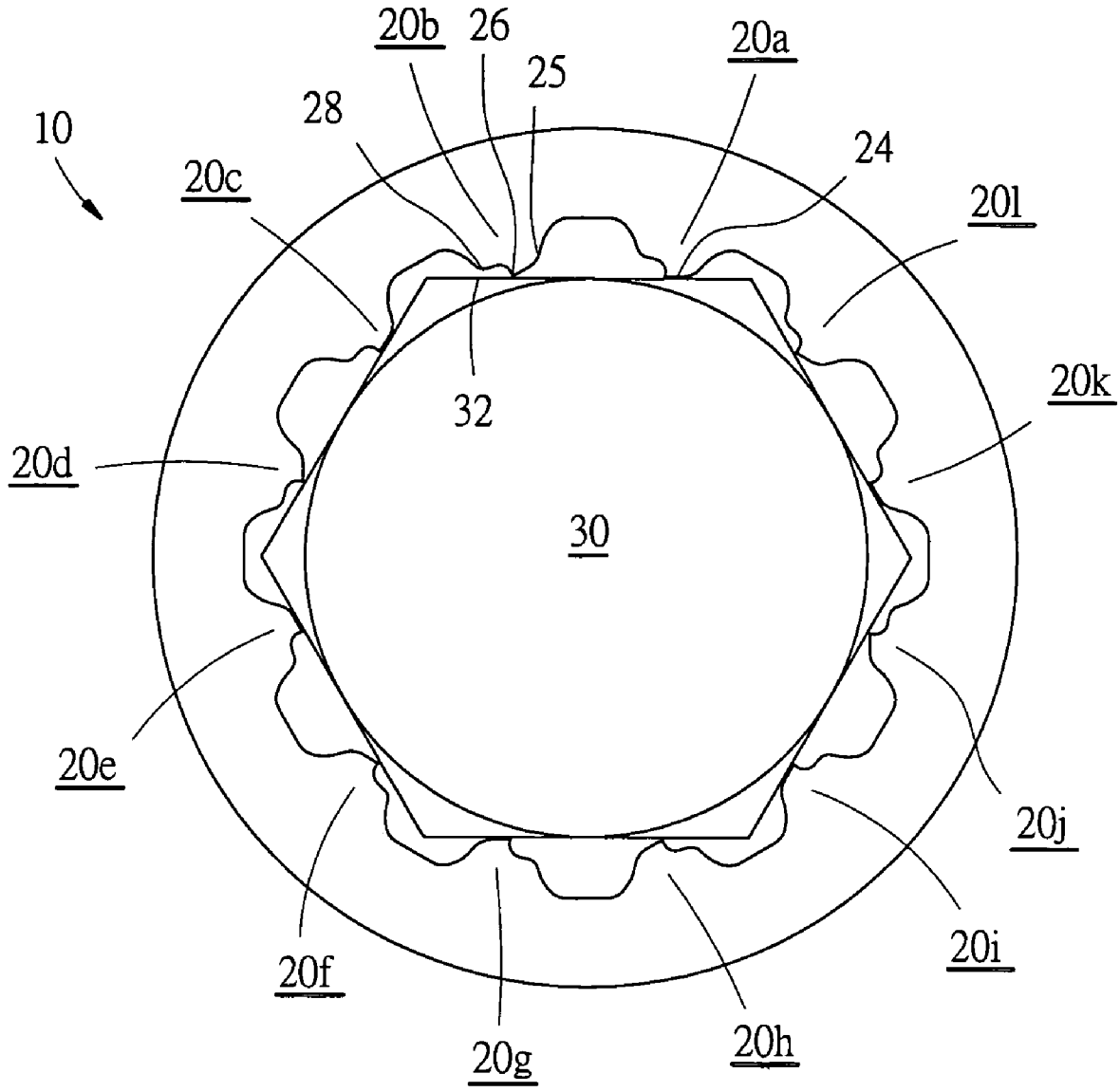
FIG. 5 shows that the fitting hole of FIG. 4 is fitted on a normal hexagonal screwing member.

FIG. 5 shows that the right-hand screwing member 30 is wrenched. When the fitting hole 10 is fitted onto the screwing member, the planes 24 of the teeth 20*a, k*, I, *g, e, c* respectively contact with one sides of the six sides 32 of the screwing member. When clockwise wrenching the socket 12 (or the wrench), the six planes 24 drive the screwing member to tighten the same. When unscrewing a normal hexagonal screwing member, the arced tooth sections 28 of the teeth will accomplish this operation. When counter-clockwise wrenching the socket, the arced tooth sections 28 of the other six teeth 20*b, d, f, h, j, l* will contact with the other sides of the six sides 32 of the screwing member to unscrew the same.

Figure 6:
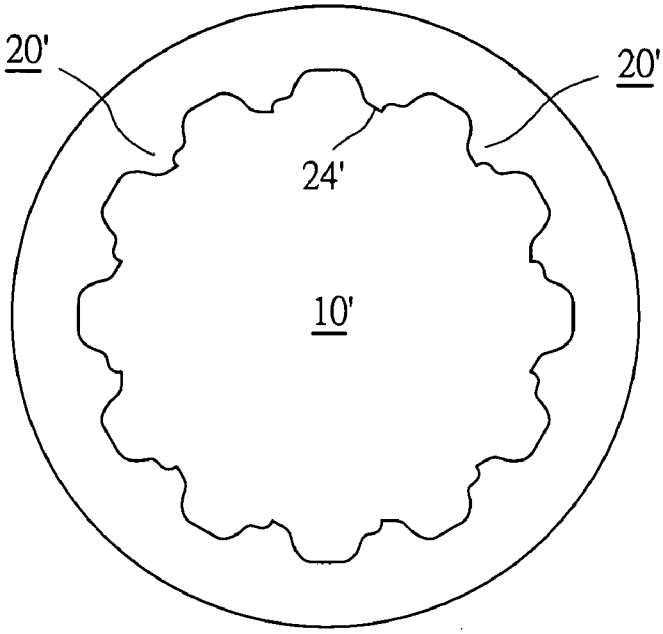
FIG. 6 is a top view of still another embodiment of the present invention.

The fitting hole 10 of FIG. 4 is designed for the right-hand screwing member. FIG. 6 shows a structure of another fitting hole 10' for wrenching left-hand screwing member, in which the tooth 20' has a configuration inverse to the configuration of the tooth 20.

Figure 7:
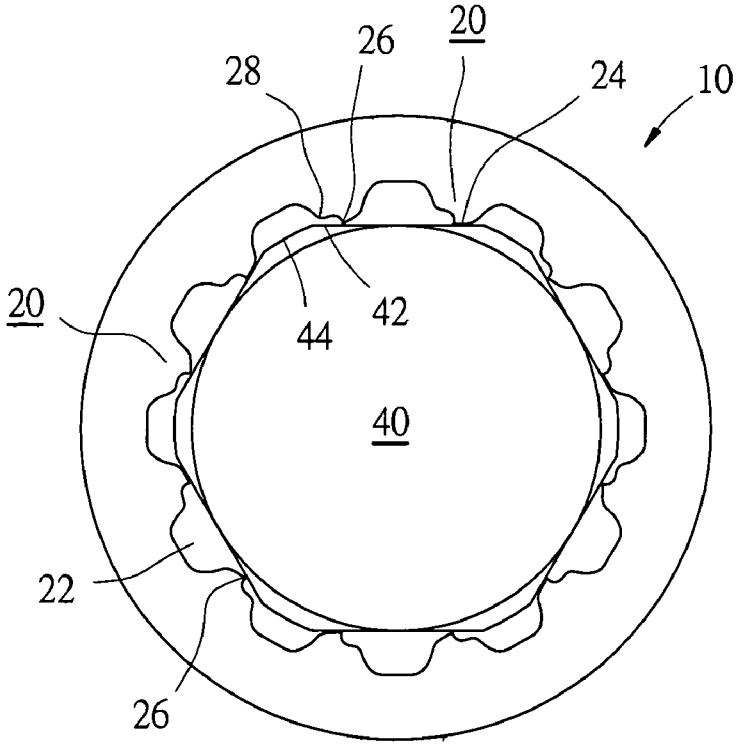
FIG. 7 shows that the fitting hole of the present invention is fitted on a worn hexagonal screwing member.

FIG. 7 shows that the fitting hole 10 is fitted onto a worn hexagonal screwing member 40. When tightening the worn screwing member 40, the six planes 24 of the six teeth 20 drive the screwing member to tighten the same. When unscrewing the worn screwing member 40 with blunted corners 44, the arced tooth sections 28 of the teeth may be unable to touch the screwing member. Under such circumstance, the acute angles 26 of the six teeth 20 will abut against the sides 42 of the screwing member 40 to unscrew the worn screwing member.

Figure 8:
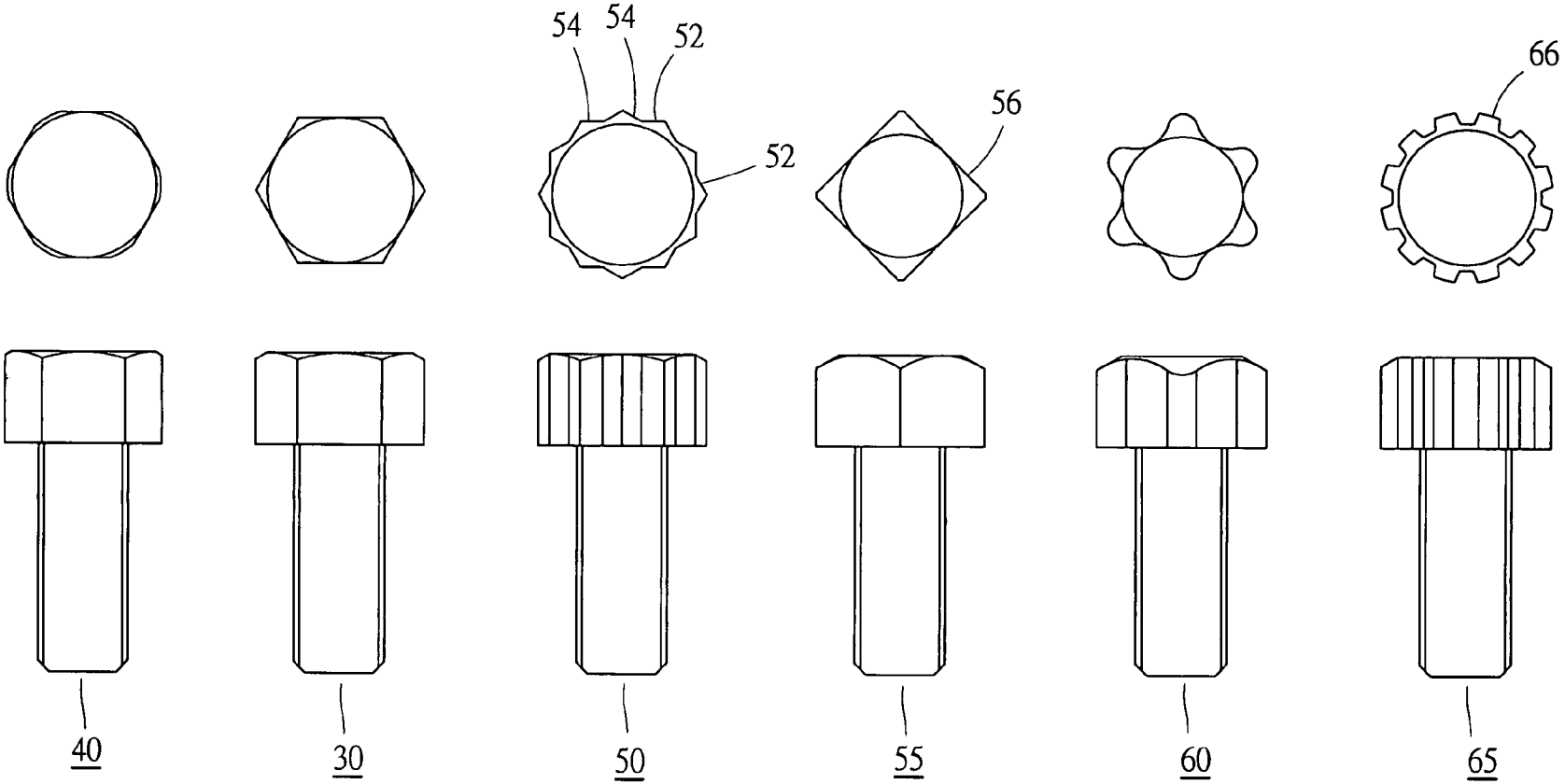
FIG. 8 shows front views and top views of various screwing members to which the fitting hole of the present invention is applicable.

FIG. 8 shows that the fitting hole of the present invention can be applied to various screwing members such as normal hexagonal screwing member 30, worn hexagonal screwing member 40, dodecagonal screwing member 50, quadrangular screwing member 55, TORX (hexalobular internal driving feature) screwing member 60 and splined screwing member 65.

Figure 9:
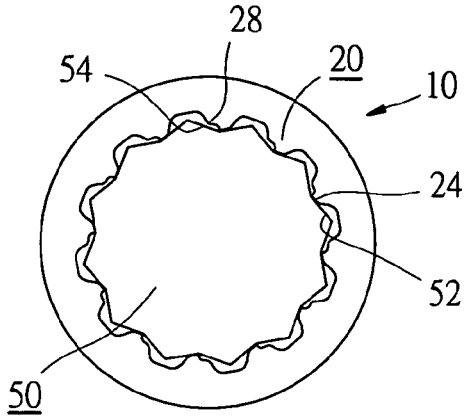
FIGS. 9 to 12 show that the fitting hole of the present invention is fitted on various kinds of screwing members.

Referring to FIG. 9, the planes 24 of the twelve teeth 20 of the fitting hole 10 contact with the twelve sides 52 of the dodecagonal screwing member 50 for tightening the screwing member. On the other hand, the arced tooth sections 28 of the teeth 20 can contact with the other twelve sides 54 of the screwing member 50 to unscrew the screwing member.

Figure 10:
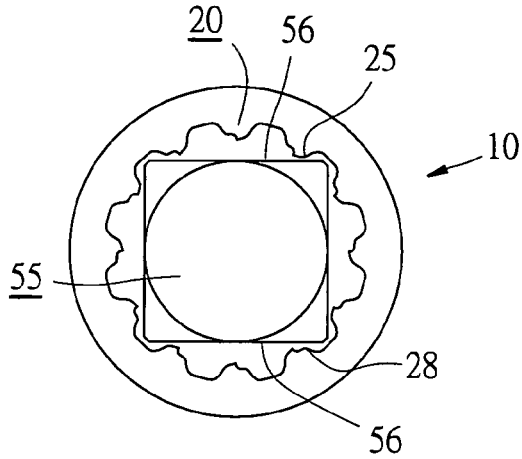

Referring to FIG. 10, the obtuse angles 25 or arced tooth sections 28 of four teeth 20 of the fitting hole 10 can contact with four sides 56 of the quadrangular screwing member 55 for tightening or unscrewing the same.

Figure 11:
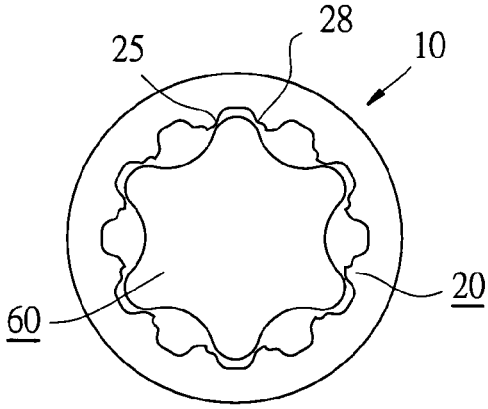
Figure 12:
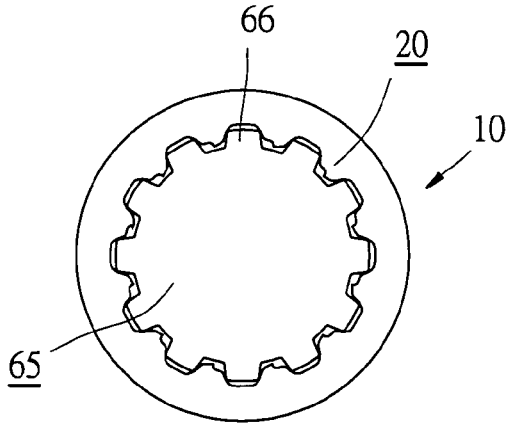

Referring to FIGS. 11 and 12, similarly, by means of the teeth 20 of the fitting hole, the TORX screwing member 60 and the splined screwing member 65 can be tightened or unscrewed.

The above embodiments are only used to illustrate the present invention, not intended to limit the scope thereof. Many modifications of the above embodiments can be made without departing from the spirit of the present invention.

What is claimed is:

1. A fitting hole of a hand tool such as a socket or a wrench for fitting on and wrenching a screwing member, the fitting hole comprising:

an inner wall of the fitting hole being formed with twelve teeth at equal intervals, the teeth defining therebetween twelve recesses at equal intervals; each tooth having a tip, the tip being formed with a plane, the plane of the tooth is angled 15 degrees away from a tangent of the tooth being tangent to an imaginary interior circle formed by the engaging teeth; a first end of the plane being closer to a center of the fitting hole than a second end of the plane, the first end of the plane having an acute angle.

2. The fitting hole as claimed in claim 1, wherein a second end of the plane of the tooth is farther from the center of the fitting hole and positioned on one side of the tooth; an arced tooth section being formed on the other side of the tooth.

3. The fitting hole as claimed in claim 1, wherein an obtuse angle is formed on the second end of the plane.

4. The fitting hole as claimed in claim 2, wherein an obtuse angle is formed on the second end of the plane.

5. The fitting hole as claimed in claim 1, wherein the acute angle is positioned in the middle of the width of the tooth.

6. A fitting hole of a hand tool such as a socket or a wrench for fitting on and wrenching a screwing member, the fitting hole comprising: an inner wall of the fitting hole being formed with twelve teeth at equal intervals, the teeth defining therebetween twelve recesses at equal intervals; each tooth having a tip, the tip being formed with a plane, the plane of the tooth is angled 15 degrees away from a tangent of the tooth being tangent to an imaginary interior circle formed by the engaging teeth; a first end of the plane being farther from a center of the fitting hole than a second end of the plane, the first end being positioned on one side of the tooth; an arced tooth section being formed on the other side of the tooth.

7. The fitting hole as claimed in claim 6, wherein an obtuse angle is formed on the first end of the plane of the tooth.

8. The fitting hole as claimed in claim 6, wherein a second end of the plane is closer to the center of the fitting hole, the second end of the plane being positioned in the middle of the width of the tooth.

9. The fitting hole as claimed in claim 8, wherein an acute angle is formed on the second end of the plane.

10. The fitting hole as claimed in claim 7, wherein a second end of the plane is closer to the center of the fitting hole, the second end of the plane being positioned in the middle of the width of the tooth.

11. The fitting hole as claimed in claim 10, wherein an acute angle is formed on the second end of the plane.

* * * * *